United States Patent [19]

Solla

[11] Patent Number: 4,664,384

[45] Date of Patent: May 12, 1987

[54] FLEXIBLE HOCKEY GOAL FRAME

[76] Inventor: Phillip J. Solla, 203 Otis La., W. Bay Shore, N.Y. 11706

[21] Appl. No.: 883,366

[22] Filed: Jul. 8, 1986

[51] Int. Cl.[4] ..... A63B 63/00

[52] U.S. Cl. ..... 273/127 B; 273/55 D

[58] Field of Search ..... 273/127 R, 127 B, 55 D, 273/26 A, 1 B, 410, 411, 177, 342; 446/27, 28, 29; 403/118, 129, 220, 223, 291, 224, 225, 227, 229, 230

[56] References Cited

U.S. PATENT DOCUMENTS

| | | | |
|---|---|---|---|
| 2,449,708 | 9/1948 | Lindsay | 273/127 B |
| 3,979,120 | 9/1976 | Dietrich | 273/127 B |
| 4,133,125 | 1/1979 | Lariosa | 403/229 |
| 4,420,158 | 12/1983 | Klock et al. | 273/127 B |
| 4,473,227 | 9/1984 | Klaus | 273/26 A |

*Primary Examiner*—Richard C. Pinkham
*Assistant Examiner*—T. Brown
*Attorney, Agent, or Firm*—Schwartz, Jeffery, Schwaab, Mack, Blumenthal & Evans

[57] ABSTRACT

A flexible hockey goal frame includes a pair of front upright members, connected at the top by an upper transverse member. A top goal member extends rewardly and is spaced apart from a base member mounted on the ice, and a center goal member extends from the top goal member to the base. The front uprights and center goal member are in the form of coil springs which collapse and then return to then normal position when struck by a player.

11 Claims, 7 Drawing Figures

FLEXIBLE HOCKEY GOAL FRAME

BACKGROUND OF THE INVENTION

1. Field of the Invention

The invention relates to hockey goal frames and particularly to a goal sufficiently flexible to collapse on impact and then return to its upright position.

2. Related Art

Rigid goal frames can cause player injuries when run into or when a player is pushed into them. Further, when a goal is knocked off its stanchions, it causes delays of the game and possible penalties.

Two early patents, U.S. Pat. Nos. 2,449,708 and 2,525,304, illustrate yieldable goal frames employing spring members, as does U.S. Pat. No. 3,979,120.

U.S. Pat. No. 2,449,708 has coil springs wrapped around rigid articulated post sections, the springs being designed to return the sections to a vertical position.

U.S. Pat. No. 2,525,304 uses springs and fluid filled cylinders to restore the posts to a vertical position.

U.S. Pat. No. 3,979,120 has a plurality of resilient helical springs positioned between a number of frame members to restore the deformed goal to its original position.

Each of the above discussed devices have solid upright frames which while buckling or pivoting, themselves remain solid and do not flex when hit.

OBJECTS AND SUMMARY OF THE INVENTION

It is an object of the invention to provide goal frames having generally upright members which are flexible.

Another object is the provision of a goal frame which will remain in place, even when run into by a player, but which will lessen the chance of injury.

A flexible hockey goal frame includes a pair of front upright members, connected at the top by an upper transverse member. A top goal member extends rewardly and is spaced apart from a base member mounted on the ice, and a center goal member extends from the top goal member to the base. The front uprights and center goal member are in the form of coil springs which collapse and then return to their normal position when struck by a player.

BRIEF DESCRIPTION OF THE DRAWINGS

The above and other objects and advantages will be appreciated from the following description and accompanying drawings, wherein.

DETAILED DESCRIPTION OF THE INVENTION

Figure 1:
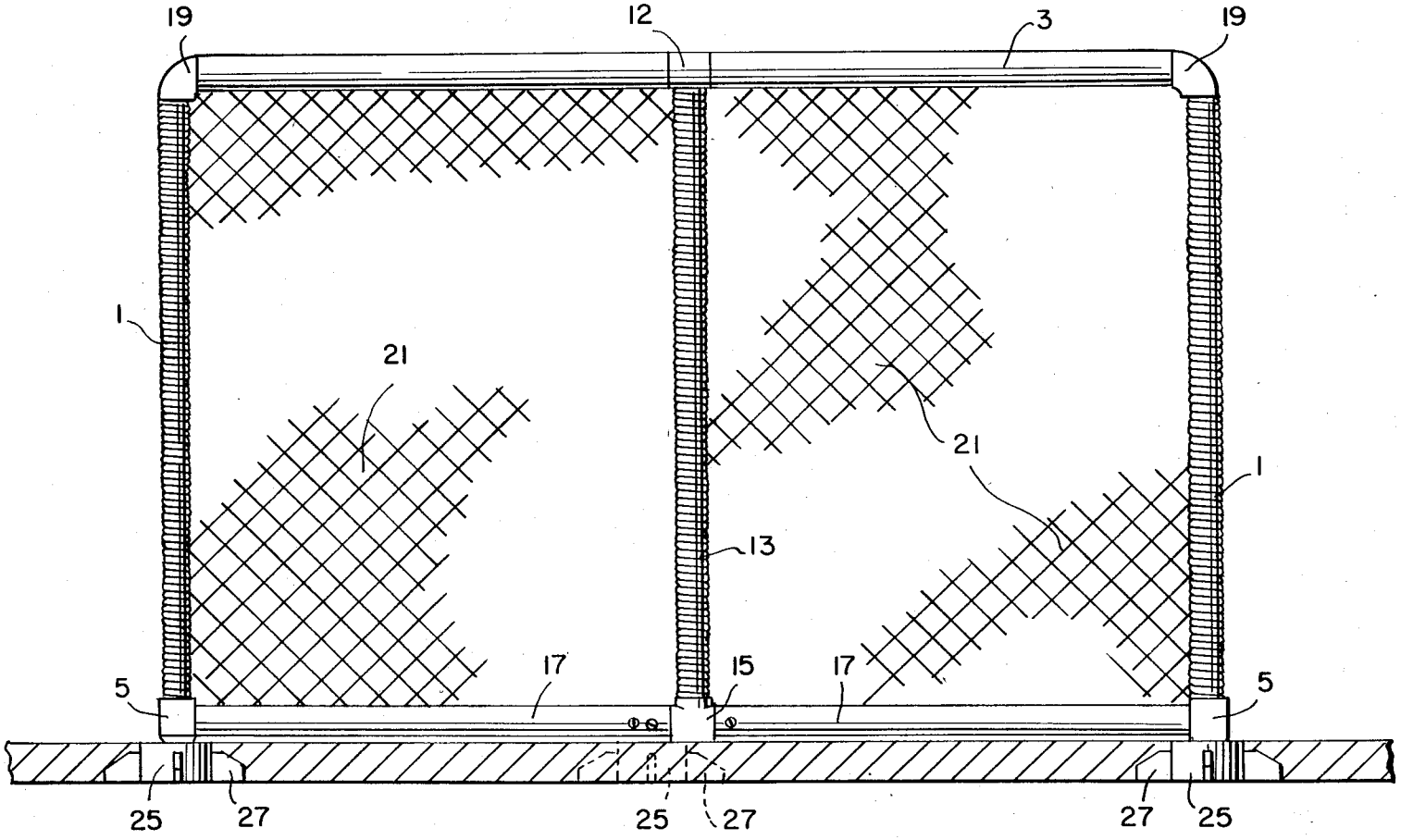
FIG. 1 is a front elevation view of a goal frame according to the instant invention.

A goal frame has a pair of substantially vertical front upright goal posts 1, each formed of a coil spring. The posts are connected at the top to a front tubular metal frame portion or upper transverse goal means 3 of a top goal member and at the bottom to a pair of front base fittings 5 of a base portion. The top member has a central rewardly extending tubular metal frame portion 7 and a curved tubular metal frame portion 9 meeting at a rear top fitting 11 in the rear and a front top fitting 12 to form a top goal means. Extending downwardly from fitting 11 is a third coil spring post forming a center goal means 13. Post 13 extends at an angle down to a rear base fitting 15 on a curved rear tubular metal base member 17. The top member 3 joins members 9 and posts 1 at a pair of fittings 19.

Portions of the goal frame not made of coil spring, for example, elements 3, 7, 9 and 17 have a protective padding thereon. Protective padding can also be wrapped around the spring members 1 and 13. Thus, the player will not come in contact with steel or other metal members and will be cushioned, not only by the springs, but also by the padding. The front upright members 1 and rear member 13, and the cross members such as element 3 may all be encased in, for example, a one-quarter inch thick rubber sleeve that will have a hidden closure fastener in the form of hooks and loops such as that sold under the trademark "VELCRO." The rubber sleeve can have the hook or fastener element sewn to it and which will in turn accept corresponding hook or fastener or elements sewn onto the netting 21. In this manner the need for lacing the netting to the goal frame is eliminated. A similar hook and loop fastening system can also be used to secure the netting to the base members 17.

Figure 4:
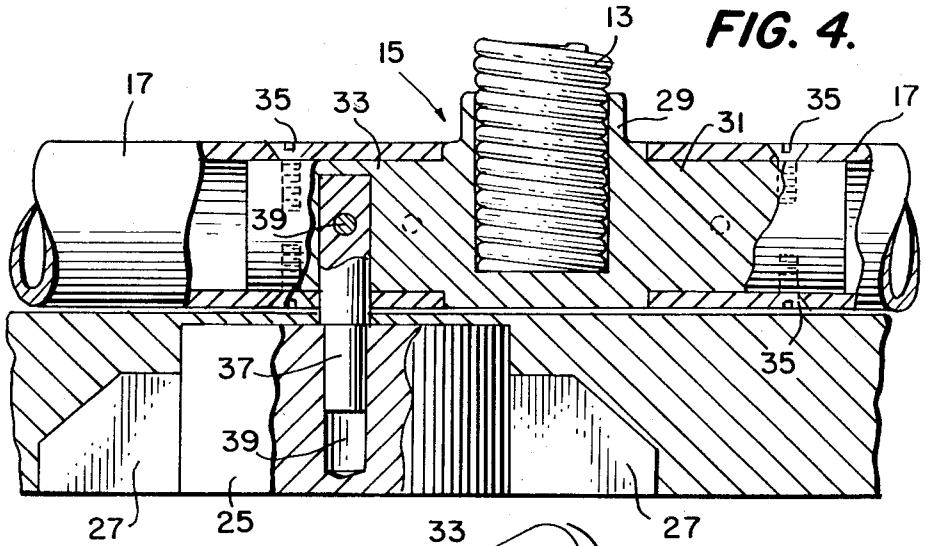
FIG 4 is a cross-sectional view of a fitting taken along lines 4—4 in FIG. 3.
Figure 5:
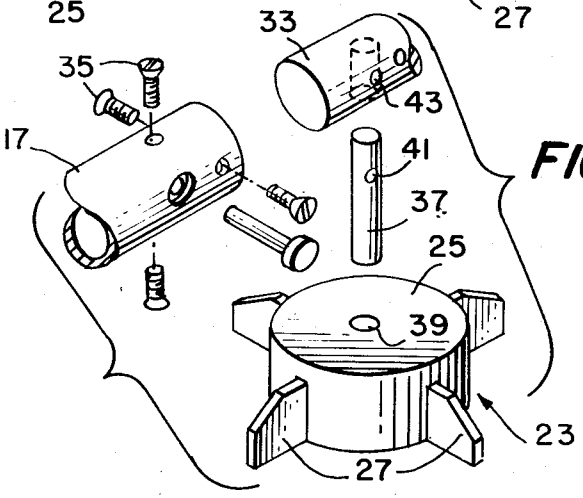
FIG. 5 is an exploded view of the mounting.
Figure 2:
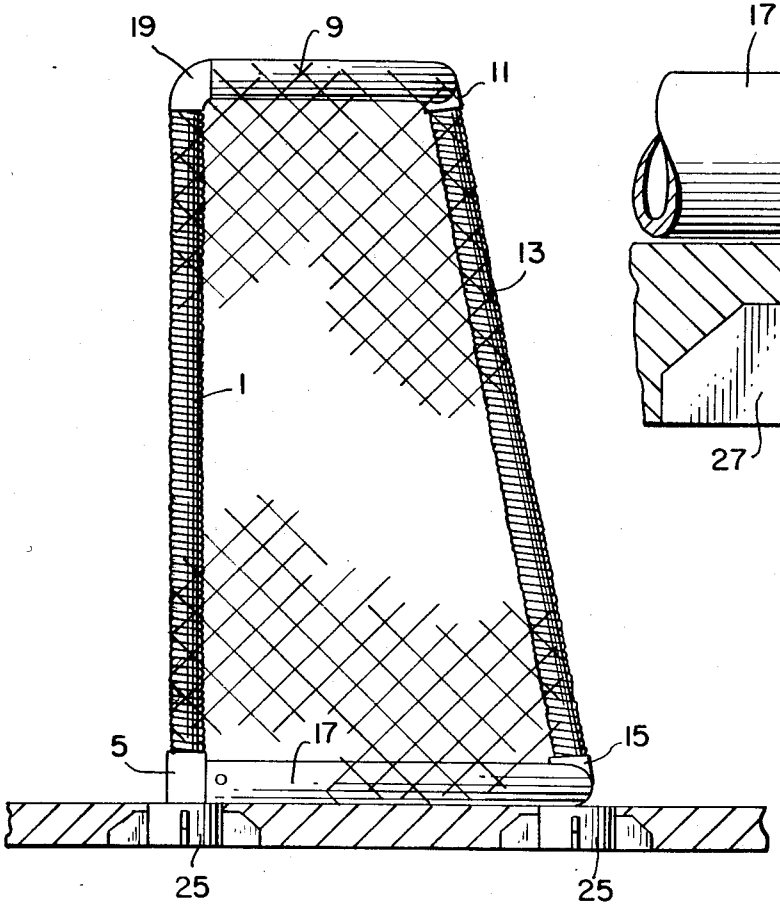
FIG. 2 is a side elevation view thereof.

Referring to FIGS. 4 and 5, anchoring means is disclosed wherein a mounting block 23 having a central cylindrical portion 25 and a plurality of wing members 27 which prevent rotation of the mounting block 23 in ice. The fitting further includes means to secure, for example, base member 17 to a T fitting having a base 29 and a pair of extending portions 31 and 33. The tubular metal base member 17 has a plurality of holes conforming with holes in elements 31 and 33 to receive a plurality of screws 35. Element 33 has an adjustable mounting pin 37 secured by a dowel 39 in cooperating holes 41 and 43. The mounting pin 37 fits into an opening 39 in the central portion of cylinder 25. The mounting block is embedded in ice as seen in FIGS. 1 and 4.

Figure 3:
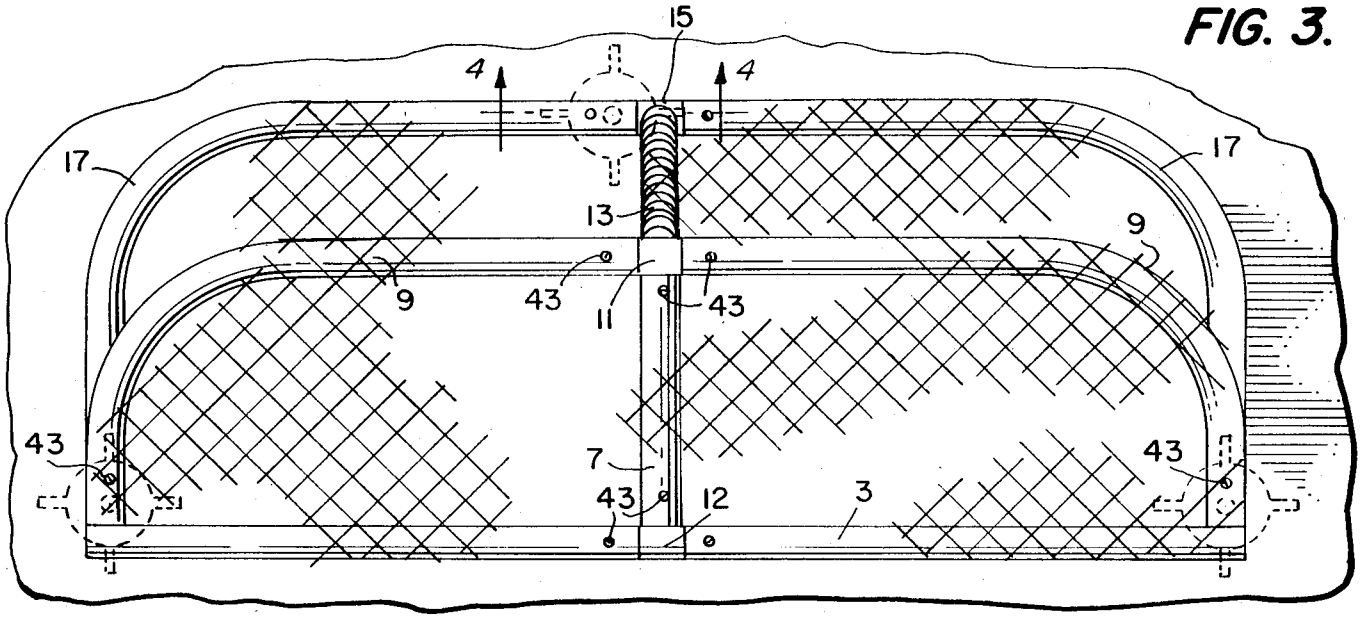
FIG. 3 is a top plan view thereof.
Figure 7:
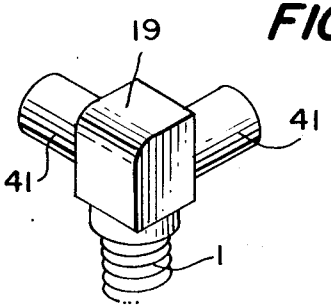
FIGS. 6 and 7 are details of fittings.
Figure 6:
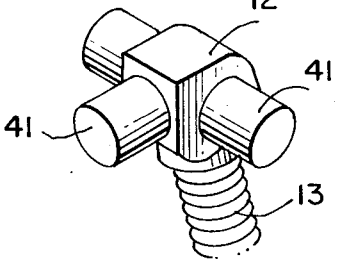

Referring to FIGS. 6 and 7, a pair of top fittings are shown having a plurality of posts 41 extending therefrom. These are mounted as seen in FIG. 3 by screws 43 extending through the tubular members 9 which in turn are screwed into complementary threaded openings in top member 9 and 7.

It will be appreciated that the mounting blocks 23 are embedded in the ice, the goal frame is assembled as discussed above, the net is secured around the goal frame, and pins 37 retain the goal frame in the mounting blocks in the ice. When a player strikes the goal frame, the frame will remain in the mounting blocks and will collapse the spring members 1 and 13 which in turn will automatically right the goal frame and net.

While one embodiment of the invention has been described, it will be understood that it is capable of further modification, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A flexible goal for hockey and the like, comprising:

(a) a frame having front, rear, top and base portions including:

(1) a pair of front upright goal means, (2) an upper transverse goal means for connecting said front upright goal means, (3) a top goal means extending in a rearward direction from said upper transverse goal means for forming an upper depth of the goal, (4) a base goal means extending in a rearward direction from a base portion of said upright goal means for forming a lower depth of the goal;

(5) a center goal means formed at least substantially of a coil spring connected between said top goal means and said base goal means;

(b) at least some of said goal means in addition to said center goal means being formed of a coil spring over at least a substantial portion of the length thereof; and (c) a net extending among at least some of said goal means.

2. The goal of claim 1, including anchor means for anchoring the lower portion of said goal means to a supporting surface.

3. The goal of claim 2, wherein said anchor means includes a mounting block adapted to be embedded in the supporting surface.

4. The goal of claim 3, wherein said anchor means includes a base fitting means for joining said base goal means to said mounting block.

5. The goal of claim 4, wherein said front upright goal means is connected to said fitting means.

6. The goal of claim 4, including a mounting pin on said fitting and extending into said mounting block.

7. The goal of claim 1, including padding surrounding at least some of said goal means.

8. The goal of claim 7, including hook and loop fastening means for attaching said padding to said goal means.

9. The goal of claim 1, including a top fitting for joining said coil spring means to other of said goal means.

10. The goal of claim 1, wherein said front upright goal means are formed over substantially the entire length thereof of said coil spring.

11. A method of providing a flexible hockey goal frame comprising:

(a) embedding a mounting means in ice, (b) forming a net support with a plurality of generally upright members and a plurality of generally transverse members including a base, (c) forming the generally upright members of coil springs, attaching the coil springs to the base member, (d) mounting the base member on said mounting means whereby the goal frame will not become detached from the mounting means when contacted by a player, but the coil springs collapse upon contact and then return to their generally upright positions.

* * * * *